US008784041B2

(12) United States Patent
Durocher et al.

(10) Patent No.: US 8,784,041 B2
(45) Date of Patent: Jul. 22, 2014

(54) TURBINE SHROUD SEGMENT WITH INTEGRATED SEAL

(75) Inventors: Eric Durocher, Vercheres (CA); Guy Lefebvre, Saint-Bruno (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 503 days.

(21) Appl. No.: 13/222,022

(22) Filed: Aug. 31, 2011

(65) Prior Publication Data

US 2013/0051989 A1 Feb. 28, 2013

(51) Int. Cl.
*F01D 25/26* (2006.01)

(52) U.S. Cl.
USPC ..... 415/139; 29/527.1; 164/80; 164/111; 164/112

(58) Field of Classification Search
CPC ..... F01D 11/08; F01D 11/12; F01D 11/005; B22D 17/00; B22D 19/00; B22D 19/04; B22D 23/06; F16J 15/328
USPC ..... 415/135, 138, 139, 173.1, 173.3, 116
See application file for complete search history.

(56) References Cited

U.S. PATENT DOCUMENTS

| | | | | |
|---|---|---|---|---|
| 3,831,258 | A | 8/1974 | Elbert et al. | |
| 4,137,619 | A | 2/1979 | Beltran et al. | |
| 4,383,854 | A | 5/1983 | Dembowski et al. | |
| 4,604,780 | A | 8/1986 | Metcalfe | |
| 4,871,621 | A | 10/1989 | Bagley et al. | |
| 5,010,050 | A | 4/1991 | Wullenweber et al. | |
| 5,130,084 | A | 7/1992 | Matheny et al. | |
| 5,553,999 | A | 9/1996 | Proctor et al. | |
| 5,574,957 | A | 11/1996 | Barnard et al. | |
| 5,772,748 | A | 6/1998 | Hubbard | |
| 5,933,699 | A | 8/1999 | Ritter et al. | |
| 5,950,063 | A | 9/1999 | Hens et al. | |
| 6,102,656 | A | 8/2000 | Nissley et al. | |
| 6,217,282 | B1 | 4/2001 | Stanka | |
| 6,254,333 | B1 * | 7/2001 | Merry | 415/115 |
| 6,350,404 | B1 | 2/2002 | Li et al. | |
| 6,679,680 | B2 | 1/2004 | Um et al. | |
| 6,709,771 | B2 | 3/2004 | Allister | |
| 6,857,848 | B2 | 2/2005 | Fokine et al. | |
| 6,874,562 | B2 | 4/2005 | Knott et al. | |
| 6,910,854 | B2 | 6/2005 | Joslin | |
| 7,029,228 | B2 | 4/2006 | Chan et al. | |
| 7,052,241 | B2 | 5/2006 | Decker | |
| 7,114,920 | B2 | 10/2006 | Synnott | |
| 7,128,522 | B2 | 10/2006 | Jutras | |
| 7,175,387 | B2 | 2/2007 | Kreis et al. | |
| 7,217,081 | B2 | 5/2007 | Scheurlen et al. | |
| 7,234,920 | B2 | 6/2007 | Imbourg et al. | |
| 7,407,622 | B2 | 8/2008 | Voice et al. | |
| 7,687,021 | B2 * | 3/2010 | Imbourg et al. | 419/8 |
| 7,857,581 | B2 | 12/2010 | Mons et al. | |
| 7,875,340 | B2 | 1/2011 | Cho et al. | |
| 2005/0214156 | A1 | 9/2005 | Troitski et al. | |
| 2010/0247298 | A1 * | 9/2010 | Nakamura et al. | 415/173.1 |
| 2011/0033331 | A1 | 2/2011 | Tuppen et al. | |
| 2012/0186768 | A1 | 7/2012 | Sun et al. | |

* cited by examiner

*Primary Examiner* — Edward Look
*Assistant Examiner* — William Grigos
(74) *Attorney, Agent, or Firm* — Norton Rose Fulbright Canada LLP

(57) ABSTRACT

A feather seal is positioned in a mold and a shroud body is metal injection molded about a proximal end of the feather seal to provide a shroud segment with an integrated feather seal. A seal groove is provided in an opposite lateral side of the shroud body to receive the feather seal of a circumferentially adjacent shroud segment.

20 Claims, 4 Drawing Sheets

TURBINE SHROUD SEGMENT WITH INTEGRATED SEAL

TECHNICAL FIELD

The application relates generally to the field of gas turbine engines, and more particularly, to turbine shroud segments.

BACKGROUND OF THE ART

The turbine shrouds surrounding turbine rotors are normally segmented in the circumferential direction to allow for thermal expansion. Being exposed to very hot combustion gasses, the turbine shrouds usually need to be cooled. Since flowing coolant through a shroud assembly diminishes overall engine performance, it is desirable to minimize cooling flow consumption without degrading shroud segment durability. Individual feather seals are typically installed in confronting slots defined in the end walls of circumferentially adjacent turbine shroud segments to prevent undesirable cooling flow leakage at the inter-segment gaps between adjacent shroud segments. While such feather seal arrangements generally provide adequate inter-segment sealing, there is a continued need to provide better sealing and, thus, minimize coolant flow consumption.

It has also been found through thermal analysis that relatively hot spots can occur in the slotted end wall regions of the shroud segments. The slot which accepts the feather seal breaks the heat flow path from the radially inner hot gaspath side of the segment to the radially outer cooled side thereof. Accordingly, in some cases, the segment may be not sufficiently cooled at this feather seal location.

There is thus a need to provide an improved turbine shroud arrangement which addresses theses and other limitations of the prior art.

SUMMARY

In one aspect, there is provided a turbine shroud segment for a turbine shroud of a gas turbine engine, the segment comprising a metal injection molded (MIM) shroud body, the MIM shroud body being axially defined from a leading edge to a trailing edge in a direction from an upstream position to a downstream position of a hot gas flow passing through the turbine shroud, and being circumferentially defined between opposite first and second lateral sides, said MIM shroud body including a platform having a hot gas path side surface and a back side surface, and forward and aft arms extending from the back side surface of the platform, said forward and aft arms being axially spaced-apart from each other, a seal groove defined in the first lateral side of the MIM shroud body; and a feather seal projecting integrally from the second lateral side of the MIM shroud body for engagement in the seal groove of a similar circumferentially adjacent turbine shroud segment, the feather seal being made from a different material than said MIM shroud body and having a proximal end imbedded in said second lateral side of said MIM shroud body.

In a second aspect, there is provided a method of manufacturing a turbine shroud segment for a gas turbine engine, the method comprising: providing a feather seal insert; holding the feather seal insert in position in a metal injection mold; and metal injection molding (MIM) a shroud segment body about a proximal end of the feather seal insert to form a green turbine shroud segment body with the feather seal insert projecting integrally from a first circumferential end thereof, and subjecting the green turbine shroud segment body with the integrated feather seal insert to debinding and sintering operations.

In a third aspect, there is provided a turbine shroud assembly of a gas turbine engine, comprising a plurality of shroud segments disposed circumferentially one adjacent to another, each of the shroud segment having a metal injection molded body (MIM) being axially defined from a leading edge to a trailing edge in a direction from an upstream position to a downstream position of a hot gas flow passing through the turbine shroud assembly, and being circumferentially defined between opposite first and second lateral sides, said MIM shroud body including a platform having a hot gas path side surface and a back side surface, and forward and aft arms extending from the back side surface of the platform, said forward and aft arms being axially spaced-apart from each other, each of the shroud segments further comprising an integral feather seal projecting from the second lateral side for engagement in a corresponding seal groove defined in the first lateral side of a circumferentially adjacent shroud segment, the integral feather seal being provided in the form an insert having a proximal end imbedded in the MIM shroud body of the shroud segment.

DESCRIPTION OF THE DRAWINGS

Reference is now made to the accompanying figures, in which.

DETAILED DESCRIPTION

Figure 1:
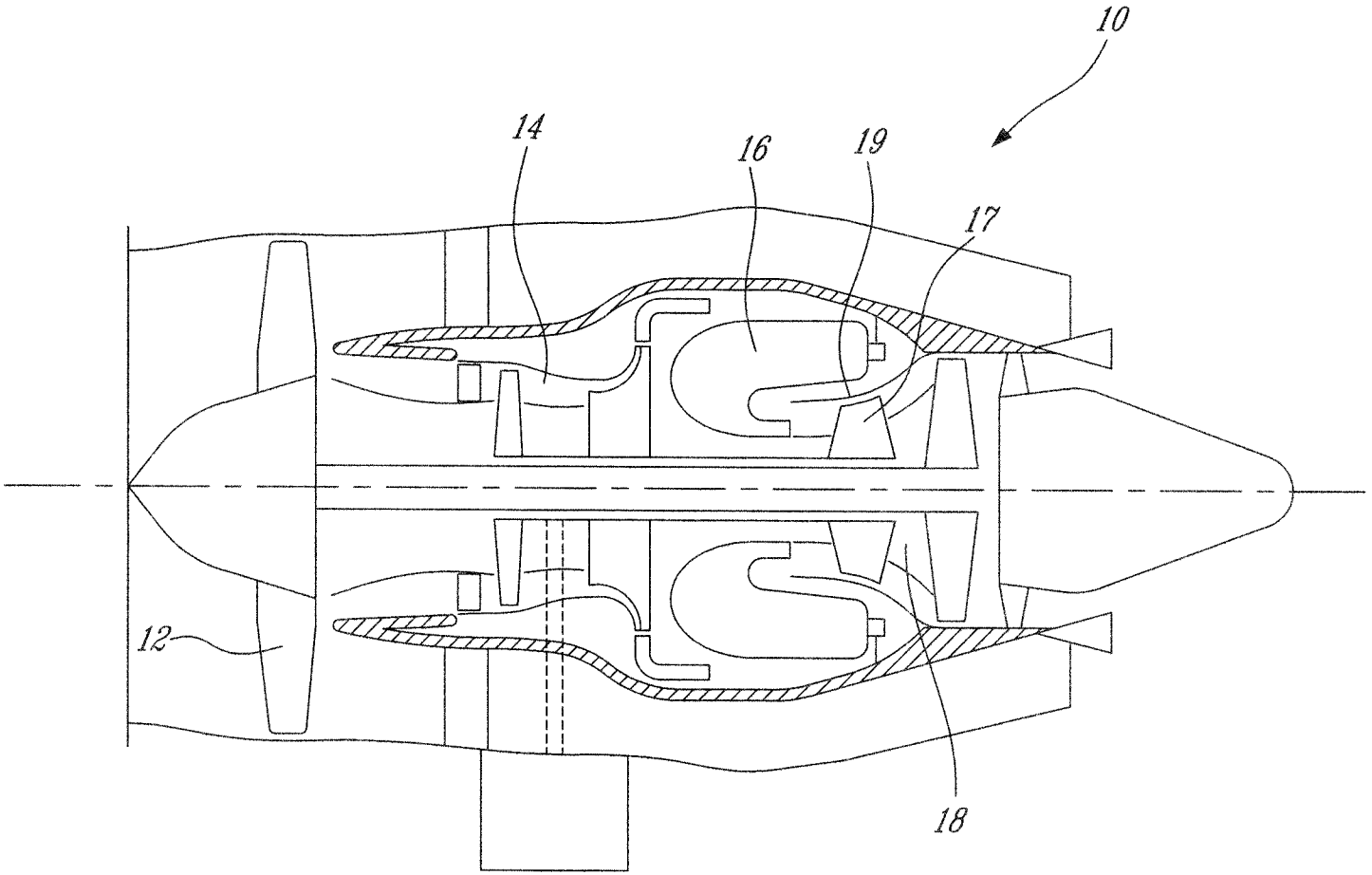
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
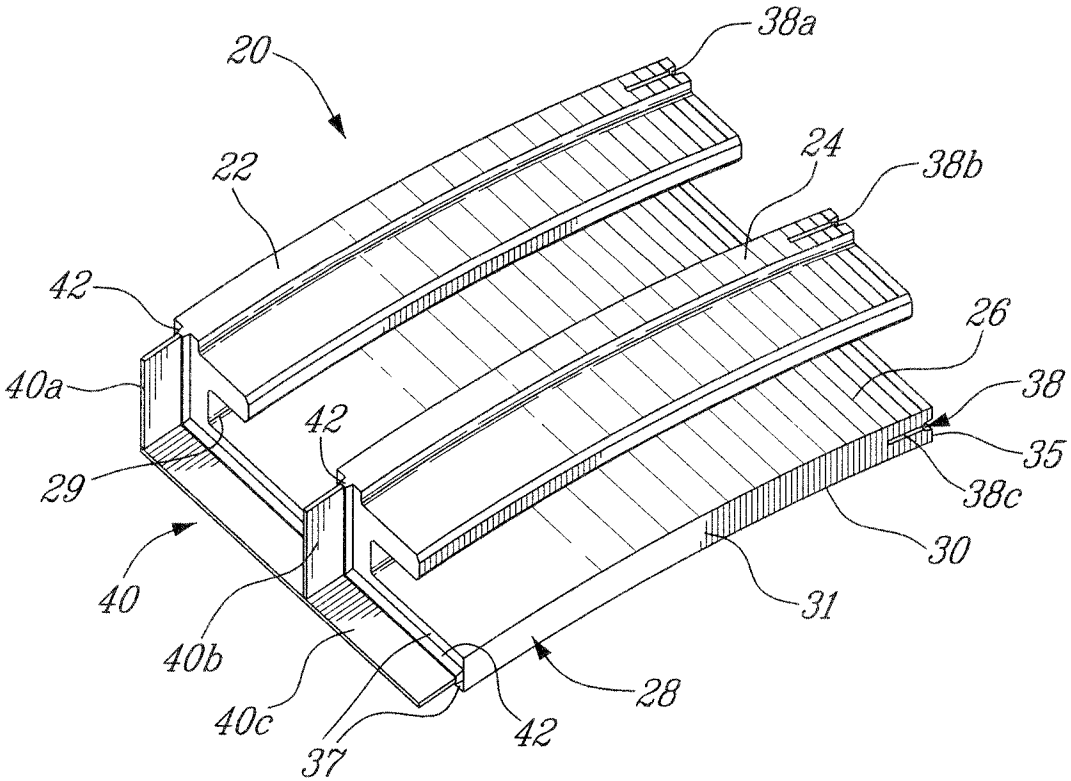
FIG. 2 is an isometric view of a metal injected molded (MIM) turbine shroud segment having an integral seal projecting from one end wall thereof for engagement in a slot defined in an opposed facing end wall of a circumferentially adjacent shroud segment.

The turbine section 18 generally comprises one or more stages of rotor blades 17 extending radially outwardly from respective rotor disks, with the blade tips being disposed closely adjacent to an annular turbine shroud 19 supported from the engine casing. The turbine shroud 19 includes a plurality of shroud segments disposed circumferentially one adjacent to another. FIG. 2 illustrates an example of one such turbine shroud segments 20.

As shown in FIG. 2, the shroud segment 20 extends axially from a leading edge 29 to a trailing edge 31 in a direction from an upstream position to a downstream position of a hot gas flow passing through the turbine shroud 19, and circumferentially between opposite first and second lateral sides 35, 37. The shroud segment 20 has axially spaced-apart forward and aft arms which may be provided in the form of hooks 22 and 24 extending radially outwardly from a back side or cold radially outer surface 26 of an arcuate platform 28. The hooks 22 and 24 define therebetween a cavity which is in fluid flow communication with a source of coolant (e.g. bleed air from the compressor 14). The hooks 22 and 24 are adapted for engagement with a surrounding shroud support structure (not shown). The platform 28 has an opposite radially inner hot gas flow surface 30 adapted to be disposed adjacent to the tip of the turbine blades 17. Cooling passages (not shown) are typically defined in the platform 28 for receiving cooling air under pressure from the cavity between the forward and aft hooks 22 and 24.

It is desirable to provide adequate seals between adjacent shroud segments to prevent cooling air within the cavity between the forward and aft hooks 22 and 24 on the cold side of the platform 28 from leaking into the engine gaspath. A seal groove 38 is defined in the first lateral side 35 of the shroud segment 20. A feather seal 40 extends integrally from the second lateral side 37 of the shroud segment 20 for sealing engagement in the seal groove 38' of a circumferentially adjacent shroud segment 20' (see shown in FIG. 3). As will be seen hereinafter, the feather seal 40 may be integrated into the shroud segment 20 by metal injection molding (MIM) the body of the shroud segment 20 about a proximal end of the feather seal 40. The feather seal 40 may be provided in the form of a sheet metal insert partly imbedded into the MIM material. As opposed to casting, the MIM process can be conducted at temperatures which are well below the melting point of the feather seal material and as such the feather seals can be integrated to the shroud segments. This would not be possible with a conventional casting process where the temperature of the molten metal is over the meting point of conventional sheet metal feather seals. Any sheet metal feather seal placed in the casting mold would be damaged by the molten metal.

The seal groove 38 and the feather seal 40 have complementary configurations to provide for proper inter-segment sealing. According to the illustrated embodiment, the seal groove 38 has forward and aft axially sealing portions 38*a* and 38*b* provided respectively in the forward and aft hooks 22 and 24 of the shroud segment 20, and a radially sealing groove portion 38*c* provided in the platform 28. The feather seal 40 has corresponding forward and aft axially sealing legs 40*a* and 40*b* projecting respectively from the forward and aft hooks 22 and 24 and a radially sealing base 40*c* projecting from the platform 28. It is understood that the feather seal 40 and associated seal groove 38 can adopt any suitable configurations. For instance, the feather seal and the seal groove could be provided only in the platform 28 or in the hooks 22, 24. According to another configuration, no feather seal and seal groove are provided in the rear overhanging portion of the platform 28, i.e. the portion of the platform 28 extending axially aft of the aft hook 24.

The feather seal 40 may be provided as a one-piece component or as a multi-piece component. In other words, the forward and aft axially sealing legs 40*a*, 40*b* and the radially sealing base 40*c* may be provided as a one-piece component or as three separate sealing parts. The feather seal 40 may be made out of a thin flexible piece of sheet metal. Other suitable heat resistant materials could be used as well. However, the material selected for the feather seal 40 shall allow for a strong bond between the feather seal 40 and the MIM shroud body. The selected material must also be able to withstand the pressures and temperatures inside the mold during the MIM process as well as the temperatures to which the MIM part is subject during the debinding and sintering operations. The feather seal 40 does not need to be made from the same metal alloy as the MIM material. However, it may help to use the same metal alloy so as to maximize bonding. For instance, the feather seal 40 could be made from Nickel or Cobalt alloys (e.g.: IN625, X-750, IN718, Haynes 188).

As can be appreciated from FIG. 2, MIM shroud body of the shroud segment 20 may have a male projection 42 integrally formed on the second lateral side 37 of the forward and aft hooks 22, 24 and of the platform 28. The feather seal 40 project outwardly from the male projection 42. This feature (i.e. the male projection at the base of feature seal) is defined to protect the seal 40 from direct hot gas radiation. The male projection 42 may also act as protective device for the seal 40 by limiting radial excursion (relative deflection) of adjacent shroud segments that could over bend/stress seal.

Figure 3:
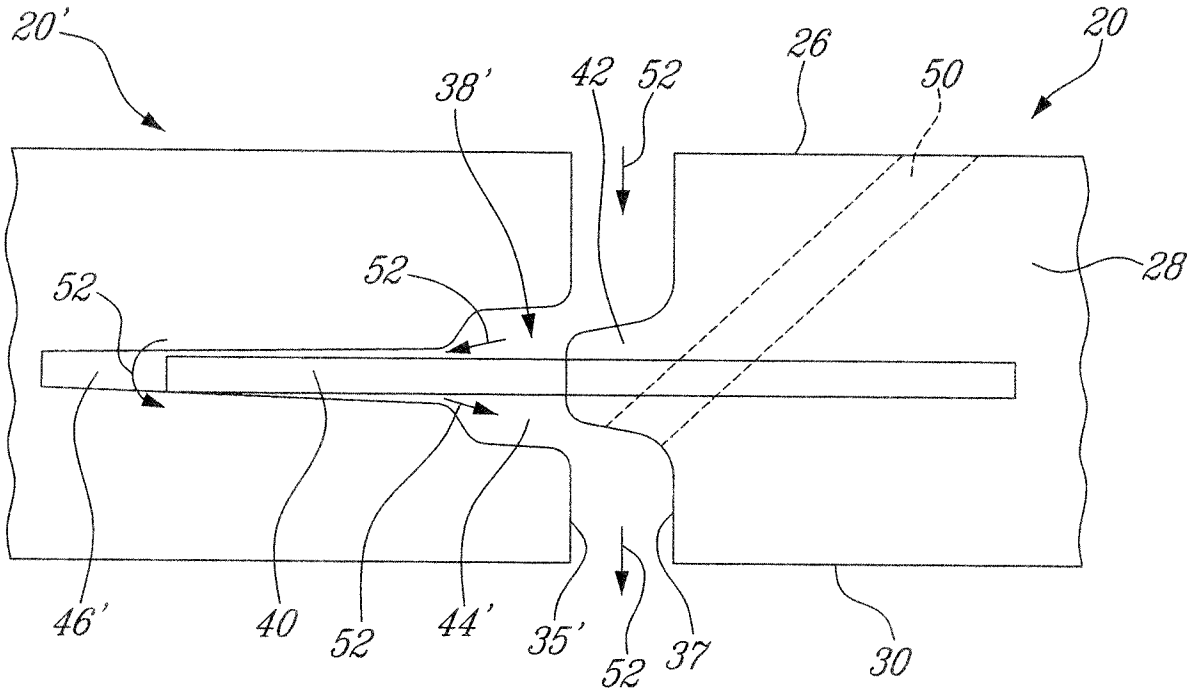
FIG. 3 is a partial cross-section view illustrating the sealing interface between two circumferentially adjacent shroud segments.

As best shown in FIG. 3 in connection with shroud segment 20', the seal groove 38' of each shroud segment has a corresponding enlarged entry portion 44'. The enlarged entry portion 44' is adapted to accommodate the male projection 42 of the adjacent shroud segment 20. Each seal groove 38' further has a feather seal receiving portion 46' which tapers away from the enlarged entry end portion 44'. In running condition, the taper profile of the seal groove 38' forces interference with the associated feather seal 40 which is engaged therein in the event that the coolant flow pressure in the cavity between the forward and aft hooks 22 and 24 and the platform 28 is not sufficient to deflect the seal 40 against the walls of the seal groove 38'.

Thermal analysis shows that transpiration cooling of the platform 28 provided by directing cooling air through cooling passages in the platform is effective for most of the area of the platform 28, but less effective for cooling the areas close the opposite lateral sides 35 and 37 thereof, particularly when the feather seal has a radially sealing base 40*c* extending between the mating sides of circumferentially adjacent platforms. The integration of the feather seal 40 in the lateral side 37 of the shroud segment 20 eliminates the need for a groove in the lateral side for receiving the end of a conventional separate feather seal and, thus, provides more design flexibility to position one or more cooling holes 50 closer to the lateral side of the platform 28. As shown in FIG. 3, cooling holes 50 may extend through the lateral side 37 at the platform level without the constraints typically imposed by the presence of a seal groove for receiving the feather seal. The elimination of a seal groove in one of the opposed facing lateral sides of adjacent shroud segments allows to bring the cooling air closer to the sealing interface and, thus, contribute to reduce the likelihood of having hot spots on the side edges of the platforms 28 of the shroud segments 20. Therefore, it can be said the integration of a feather seal on one lateral side of the shroud segment contributes to increase the service life of the shroud segments by allowing for better cooling of the opposed lateral side edges of the shroud platforms. From the above, it can be appreciated that the integrated feather seal arrangement allows cooling holes through the portion of the feather seal embedded into shroud segment to cool down shroud segment's edge. The cooling holes can be drilled through the integrated feather seals, thereby offering much more space and thus less design/manufacturing restrictions as compared to conventional designs.

Figure 4:
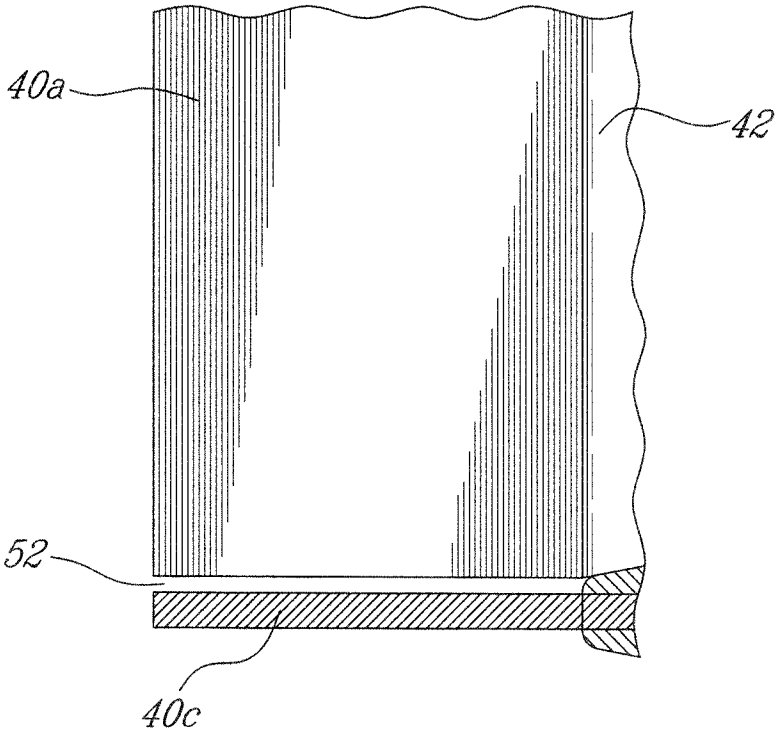
FIG. 4 is an enlarged view of feather seal details encircled in FIG. 2.

As shown in FIG. 4, a slot 52 may be provided at the junction (at the bend from axial to radial) of each of the forward and aft axially sealing leg 40*a*, 40*b* with the radially sealing base 40*c* of the feather seal 40 to facilitate seal deflection and, thus, ensure proper sealing contact between the feather seal 40 and the walls of the seal groove 38 and also to avoid stress concentration problems in the feather seal 40. If the feather seal is provided as a one-piece component, the slots 52 may be cut into the feather seal either before or after injection molding the shroud body. If the legs 40*a*, 40*b* and the base 40*c* are provided as three separate pieces, the slots 52 may be provided in the form of gaps between the adjacent ends of the seal pieces.

The manufacturing process of an exemplary turbine shroud segment may be described as follows. A feather seal is first provided and positioned in an injection mold having a plurality of mold details adapted to be assembled together to define a mold cavity having a shape corresponding to the shape of the desired turbine shroud segment 20. As mentioned herein before, the feather seal may be composed of one or more individual parts. It is noted that the mold cavity is larger than that of the desired finished part to account for the shrinkage that will occur during debinding and sintering of the green shroud segment. Appropriate tooling, such as pins or the like, can be engaged with the feather seal 40 to hold the same in position in the mold. The same pins can be used to create cooling holes, such as cooling hole 50, in the MIM shroud body. The mold details may be configured to form the seal groove 38 and the male projection 42 in the first and second opposed lateral sides 35 and 37 of the shroud body.

Once the feather seal 40 has been properly positioned in the mold, a MIM feedstock comprising a mixture of metal powder and a binder is injected into the mold to fill the mold cavity about a proximal end of the feather seal 40. The MIM feedstock may be a mixture of Nickel alloy powder and a wax binder. The metal powder can be selected from among a wide variety of metal powder, including, but not limited to Nickel alloys, Cobalt alloy, equiax single crystal. The binder can be selected from among a wide variety of binders, including, but not limited to waxes, polyolefins such as polyethylenes and polypropylenes, polystyrenes, polyvinyl chloride etc. The maximum operating temperature will influence the choice of metal type selection for the powder. Binder type remains relatively constant. Constraints for the feather seal material selection also include maximum operating temperature and MIM heat treatment temperatures.

The MIM feedstock is injected at a low temperature (e.g. at temperatures equal or inferior to 250 degrees Fahrenheit (121 deg. Celsius)) and at low pressure (e.g. at pressures equal or inferior to 100 psi (689 kPa)). The injection temperature is inferior to the melting point of the material selected to form the feather seal 40. Injecting the feedstock at temperatures higher than the melting point of the feather seal material would obviously damage the feather seal. The feedstock is thus injected at a temperature at which the feather seal 40 remains chemically and physically stable. It is understood that the injection temperature is function of the composition of the feedstock. Typically, the feedstock is heated to temperatures slightly higher than the melting point of the binder. However, depending of the viscosity of the mixture, the feedstock may be heated to temperatures that could be below or above melting point. The injection pressure is also selected so as to not compromise the integrity of the feather seal 40.

Once the feedstock is injected into the mold, it is allowed to solidify in the mold to form a green compact around the proximal end of the feather seal 40. After it has cooled down and solidified, the mold details are disassembled and the green shroud segment with its partly imbedded feather seal 40 is removed from the mold. The term "green" is used herein to generally refer to the state of a formed body made of sinterable powder or particulate material that has not yet been heat treated to the sintered state.

Next, the green shroud segment body is debinded using solvent, thermal furnaces, catalytic process, a combination of these know methods or any other suitable methods. The resulting debinded part (commonly referred to as the "brown" part) is then sintered in a sintering furnace. The sintering temperature of the various metal powders is well-known in the art and can be determined by an artisan familiar with the powder metallurgy concept. It is understood that the sintering temperature is lower than the melting temperature of the material selected for the feather seal.

Next, the resulting sintered shroud segment body may be subjected to any appropriate metal conditioning or finishing treatments, such as grinding and/or coating. Cooling passages, including cooling holes 50, may be drilled in the MIM shroud body if not already formed therein during molding.

In addition of allowing for better cooling of the lateral side edges of the platform 28 of the shroud segment 20, the integration of the feather seal to the shroud segment reduce potential air leak path by 50% as compared to conventional feather seal arrangement wherein the opposed ends of the feather seal are received in confronting grooves defined in the facing sides of circumferentially adjacent segments. Indeed, as schematically depicted by arrows 52 in FIG. 3, the cooling air can only potentially leak by flowing over the distal end of the feather seal 40. The proximal end of the feather seal 40 is imbedded in the shroud segment and, thus, the cooling air cannot flow thereover. The integration of the feather seal thus provides for reduced air consumption which results in better engine performances. The integration of the feather seal is also advantageous in that it reduces part count at assembly. It simplifies the assembly of the shroud segments by avoiding the installation of several individual "stand-alone" feather seal plates. Accordingly, assembly time and costs can be reduced. Finally, it eliminates the risk of feather seal assembly mistake that could affect shroud durability in service.

The above description is meant to be exemplary only, and one skilled in the art will recognize that changes may be made to the embodiments described without departing from the scope of the invention disclosed. For example, a wide variety of material combinations could be used for the MIM shroud body and the integrated feather seal. Also the feather seal and the body of the shroud segment may adopt various configurations. Still other modifications which fall within the scope of the present invention will be apparent to those skilled in the art, in light of a review of this disclosure, and such modifications are intended to fall within the appended claims.

The invention claimed is:

1. A turbine shroud segment for a turbine shroud of a gas turbine engine, the segment comprising a metal injection molded (MIM) shroud body, the MIM shroud body being axially defined from a leading edge to a trailing edge in a direction from an upstream position to a downstream position of a hot gas flow passing through the turbine shroud, and being circumferentially defined between opposite first and second lateral sides, said MIM shroud body including a platform having a hot gas path side surface and a back side surface, and forward and aft arms extending from the back side surface of the platform, said forward and aft arms being axially spaced-apart from each other, a seal groove defined in the first lateral side of the MIM shroud body; and a feather seal projecting integrally from the second lateral side of the MIM shroud body for engagement in the seal groove of a similar circumferentially adjacent turbine shroud segment, the feather seal being made from a different material than said MIM shroud body and having a proximal end imbedded in said second lateral side of said MIM shroud body.

2. The turbine shroud segment defined in claim 1, wherein the feather seal is a sheet metal insert, the MIM shroud body being injection molded about said sheet metal insert.

3. The turbine shroud segment defined in claim 1, wherein said MIM shroud body has a MIM male projection extending integrally from said second lateral side, and wherein said feather seal projects outwardly from said MIM male projection.

4. The turbine shroud segment defined in claim 3, wherein said seal groove has an enlarged entry portion corresponding to said MIM male projection.

5. The turbine shroud segment defined in claim 4, wherein the seal groove has a feather seal receiving portion which tapers away from said enlarged entry portion.

6. The turbine shroud segment defined in claim 1, wherein the seal groove tapers in a depthwise direction.

7. The turbine shroud segment defined in claim 1, wherein the feather seal has forward and aft axially sealing legs and a radially sealing base, the forward and aft axially sealing legs projecting respectively outwardly from the forward and aft arms of the MIM shroud body, the radially sealing base projecting outwardly from the platform of the shroud MIM body.

8. The turbine shroud segment defined in claim 7, wherein a first slot is defined in the feather seal at an interface between said forward axially sealing leg and said radially sealing base, and wherein a second slot is defined in the feather seal at an interface between said aft axially sealing leg and said radially sealing base.

9. The turbine shroud segment defined in claim 3, wherein the MIM male projection has first, second and third portions respectively projecting from the forward and aft arms and the platform.

10. The turbine shroud segment defined in claim 1, wherein cooling holes extends through said second lateral sides.

11. A method of manufacturing a turbine shroud segment for a gas turbine engine, the method comprising: providing a feather seal insert; holding the feather seal insert in position in a metal injection mold; and metal injection molding (MIM) a shroud segment body about a proximal end of the feather seal insert to form a green turbine shroud segment body with the feather seal insert projecting integrally from a first circumferential end thereof, and subjecting the green turbine shroud segment body with the integrated feather seal insert to debinding and sintering operations.

12. The method defined in claim 11, wherein metal injection molding (MIM) the shroud segment body comprises forming a male projection at said first circumferential end, said feather seal insert projecting out from said male projection.

13. The method defined in claim 11, comprising providing cooling holes through said first circumferential end of the shroud segment body.

14. The method defined in claim 11, wherein the cooling holes are defined during the MIM step.

15. The method defined in claim 12, comprising forming a seal slot in a second circumferential end of the shroud segment, the seal slot having an enlarged entry portion generally corresponding to said male projection and a seal receiving portion tapering away from said enlarged entry portion.

16. The method defined in claim 12, wherein the seal slot is defined during the MIM step.

17. The method defined in claim 11, wherein the shroud segment body is metal injection molded with forward and aft arms extending from a platform, wherein the feather seal insert has forward and aft axially sealing legs and a radially sealing base respectively projecting from the forward and aft arms and the platform of the shroud segment body, and wherein the method further comprises providing first and second slots in the feather seal insert at a first junction between said forward axially sealing leg and said radially sealing base and at a second junction between said aft axially sealing leg and said radially sealing base, respectively.

18. A turbine shroud assembly of a gas turbine engine, comprising a plurality of shroud segments disposed circumferentially one adjacent to another, each of the shroud segment having a metal injection molded body (MIM) being axially defined from a leading edge to a trailing edge in a direction from an upstream position to a downstream position of a hot gas flow passing through the turbine shroud assembly, and being circumferentially defined between opposite first and second lateral sides, said MIM shroud body including a platform having a hot gas path side surface and a back side surface, and forward and aft arms extending from the back side surface of the platform, said forward and aft arms being axially spaced-apart from each other, each of the shroud segments further comprising an integral feather seal projecting from the second lateral side for engagement in a corresponding seal groove defined in the first lateral side of a circumferentially adjacent shroud segment, the integral feather seal being provided in the form an insert having a proximal end imbedded in the MIM shroud body of the shroud segment.

19. The turbine shroud assembly defined in claim 18, wherein at least one cooling hole extends through said second lateral side.

20. The turbine shroud assembly defined in claim 18, wherein said feather seal has forward and aft axially sealing legs respectively projecting from said forward and aft arms, and a radially sealing base projecting from said platform, and wherein slots are provided in said feather seal at the junction between said forward and aft axially sealing legs and said radially sealing base.

* * * * *